US011060215B2

(12) United States Patent
Chu

(10) Patent No.: US 11,060,215 B2
(45) Date of Patent: Jul. 13, 2021

(54) REINFORCED COMPOSITE FABRIC AND METHOD FOR PREPARING THE SAME

(71) Applicant: Bright Cheers International Limited, Apia OT (WS)

(72) Inventor: Chien-Chia Chu, Taipei (TW)

(73) Assignee: Bright Cheers International Limited, Apia Ot (WS)

( * ) Notice: Subject to any disclaimer, the term of this patent is extended or adjusted under 35 U.S.C. 154(b) by 524 days.

(21) Appl. No.: 15/416,244

(22) Filed: Jan. 26, 2017

(65) Prior Publication Data

US 2018/0208724 A1 Jul. 26, 2018

(51) Int. Cl.
*D03D 15/56* (2021.01)

(52) U.S. Cl.
CPC ..... *D03D 15/56* (2021.01); *D10B 2401/041* (2013.01); *D10B 2505/02* (2013.01)

(58) Field of Classification Search
None
See application file for complete search history.

(56) References Cited

U.S. PATENT DOCUMENTS

| | | | |
|---|---|---|---|
| 2,465,319 | A | 3/1949 | Whinfield |
| 2,965,613 | A | 12/1960 | Milone |
| 3,038,833 | A | 6/1962 | Glover |
| 3,438,842 | A | 4/1969 | Petterson |
| 3,948,702 | A | 4/1976 | Theissen |
| 3,998,986 | A | 12/1976 | Williams |
| 4,109,543 | A | 8/1978 | Foti |
| 4,173,199 | A | 11/1979 | Fassina |
| 4,319,944 | A | 3/1982 | Pope |
| 4,623,574 | A | 11/1986 | Harpell |
| 4,972,522 | A | 11/1990 | Rautenberg |
| 6,044,493 | A | 4/2000 | Post |
| 6,300,257 | B1 | 10/2001 | Kirchberger |

(Continued)

FOREIGN PATENT DOCUMENTS

| | | | |
|---|---|---|---|
| CN | 1095119 | A | 11/1994 |
| CN | 1723307 | A | 1/2006 |

(Continued)

OTHER PUBLICATIONS

Machine translation of CN205255673, Zhou et al. (Year: 2016).*

(Continued)

*Primary Examiner* — Shawn Mckinnon
(74) *Attorney, Agent, or Firm* — Morrison & Foerster LLP

(57) ABSTRACT

The present invention provides a method of preparing a reinforced composite fabric. The method includes steps of: forming a high-hardness thermoplastic elastomeric yarn and a low-hardness thermoplastic elastomeric yarn with a melting point from 50° C. to 150° C. into a fabric; and hot-pressing the fabric under a hot-pressing temperature to form the reinforced composite fabric. The hot-pressing temperature is higher than or equal to the melting point of the low-hardness thermoplastic elastomeric yarn but lower than the melting point of the high-hardness thermoplastic elastomeric yarn. The present invention also provides a reinforced composite fabric made by the method. The reinforced composite fabric can be made by a simple and an eco-friendly process, and has the advantages of high tensile strength and high impact strength.

18 Claims, 2 Drawing Sheets

(56) References Cited

U.S. PATENT DOCUMENTS

| | | | | |
|---|---|---|---|---|
| 8,123,910 | B2 | 2/2012 | Eagles | |
| 8,506,749 | B1 | 8/2013 | Colasanto | |
| 2003/0162903 | A1 | 8/2003 | Day | |
| 2003/0194547 | A1 | 10/2003 | Fuhrmann | |
| 2004/0245172 | A1 | 12/2004 | Petersen | |
| 2006/0030229 | A1* | 2/2006 | Fukuoka | D04B 1/16 442/197 |
| 2008/0207846 | A1* | 8/2008 | Henze | B29C 48/04 525/452 |
| 2009/0133802 | A1 | 5/2009 | Epstein | |
| 2013/0171432 | A1 | 7/2013 | Dandapure | |
| 2013/0255103 | A1* | 10/2013 | Dua | B29C 66/244 36/87 |
| 2014/0272255 | A1 | 9/2014 | Wu | |
| 2017/0135416 | A1 | 5/2017 | Kang | |
| 2017/0253015 | A1 | 9/2017 | Chu | |

FOREIGN PATENT DOCUMENTS

| | | | |
|---|---|---|---|
| CN | 101198648 | A | 6/2008 |
| CN | 101198648 | A | 6/2008 |
| CN | 100567604 | C | 12/2009 |
| CN | 100567604 | C | 12/2009 |
| CN | 102230248 | A | 11/2011 |
| CN | 102230248 | A | 11/2011 |
| CN | 102230251 | A | 11/2011 |
| CN | 102230251 | A | 11/2011 |
| CN | 102409502 | A | 4/2012 |
| CN | 102409502 | A | 4/2012 |
| CN | 104228082 | A | 12/2014 |
| CN | 104928827 | A | 9/2015 |
| CN | 104928827 | A | 9/2015 |
| CN | 105088600 | * | 11/2015 |
| CN | 105088600 | A | 11/2015 |
| CN | 205255673 | * | 5/2016 |
| CN | 205295620 | * | 6/2016 |
| DE | 20213713 | U1 | 1/2003 |
| DE | 202008013246 | U1 | 1/2009 |
| EP | 0101305 | A2 | 2/1984 |
| EP | 0101305 | A2 | 2/1984 |
| EP | 0768406 | A1 | 4/1997 |
| EP | 0768406 | A1 | 4/1997 |
| EP | 0982431 | A2 | 3/2000 |
| GB | 1211305 | * | 11/1970 |
| GB | 1485586 | A | 9/1977 |
| JP | H04-146235 | A | 5/1992 |
| JP | H04146235 | A | 5/1992 |
| JP | H04-353525 | A | 12/1992 |
| JP | H04353525 | A | 12/1992 |
| JP | H11158775 | A | 6/1999 |
| JP | 2001-303395 | A | 10/2001 |
| JP | 2001303395 | A | 10/2001 |
| JP | 2003-113551 | A | 4/2003 |
| JP | 2003-515011 | A | 4/2003 |
| JP | 2003113551 | A | 4/2003 |
| JP | 2003515011 | A | 4/2003 |
| JP | 2006327074 | A | 12/2006 |
| JP | 2015-134973 | A | 7/2015 |
| JP | 2015134973 | A | 7/2015 |
| JP | 2016088015 | A | 5/2016 |
| JP | 2016193569 | A | 11/2016 |
| JP | 2017006628 | A | 1/2017 |
| TW | I242620 | B | 11/2005 |
| TW | 20086840 | A | 2/2008 |
| TW | 200806840 | A | 2/2008 |
| TW | M373365 | U | 2/2010 |
| TW | M373365 | U | 2/2010 |
| TW | 201240806 | A | 10/2012 |
| TW | I414544 | B | 11/2013 |
| TW | I414544 | B | 11/2013 |
| TW | M518392 | U | 3/2016 |
| TW | M518392 | U | 3/2016 |
| TW | M524789 | A | 7/2016 |
| WO | WO200138621 | A1 | 5/2001 |
| WO | WO200161105 | A1 | 8/2001 |
| WO | WO2004053218 | A1 | 6/2004 |
| WO | WO2004065680 | A1 | 8/2004 |
| WO | WO2006134138 | A1 | 12/2006 |
| WO | 2011/040359 | A1 | 4/2011 |
| WO | WO2011040359 | A1 | 4/2011 |
| WO | WO2012011487 | A1 | 1/2012 |
| WO | WO2012118665 | A1 | 9/2012 |

OTHER PUBLICATIONS

Machine translation of CN205295620, Zhou et al. (Year: 2016).*

Machine translation of CN105088600 (Year: 2015).*

Machine translation of CN 1723307, Kouji (Year: 2006).*

Hardness—Introduction, (2018). Retrieved from https://omnexus.specialchem.com/polymer-properties/properties/hardness-introduction, last visited Jan. 9, 2018, 2 pages.

Hardness Comparison Chart (No Date). Retrieved from https://www.redwoodplastics.com/brochures/plastic-hardness-comparison-chart.pdf, 1 page.

Outa, C. (Mar. 3, 2013). Spandex, retrieved from http://www.designlife-cycle.com/spandex, last visited Oct. 22, 2019, 5 pages.

Plastic Properties Table, (2018). Retrieved from https://www.curbellplastics.com/Research-Solutions/Plastic-Properties, lasted visited Jan. 9, 2018, 1 page.

Polyurethanes (2019). Polymer Science Learning Center, Retrieved from https://www.pslc.ws/macrog/urethane.htm, last visited Oct. 21, 2019, 4 pages.

* cited by examiner

REINFORCED COMPOSITE FABRIC AND METHOD FOR PREPARING THE SAME

CROSS-REFERENCE TO RELATED APPLICATION

Pursuant to 35 U.S.C. § 119(a), this application claims the benefit of the priority to Taiwan Patent Application No. 105119378, filed Jun. 21, 2016. The content of the prior application is incorporated herein by its entirety.

BACKGROUND OF INVENTION

1. Field of the Invention

The present invention relates to textile technology, and particularly relates to a reinforced composite fabric and a method for preparing a reinforced composite fabric.

2. Description of the Related Art

Due to the development of technology, the demands for the functional textiles increase. The functional textiles have different properties and functions according to different uses. Among the functional textiles, reinforced textiles are usually formed by adding a reinforcing agent or attaching a reinforcing film to enhance their strengths.

The use of reinforcing agent is more widely used between these two means. Common reinforcing agents include tear strength improver, rubbing fastness improver, or fabric enhancer. After the textile is immersed in a solution containing the reinforcing agent, a polymer layer is attached onto the surface of the textile, such that the strength of the textile can be enhanced.

However, the concentration of the reinforcing agent needs to be lower than 5% to sustain the texture of the reinforced textile, resulting in that the reinforced effect cannot be effectively improved. Using the reinforcing agent to enhance the strength requires additional impregnation process and drying process, resulting in a more complicated process, longer processing time, and higher cost. Besides, large consumptions of water and solvent during the process cause large burdens to the environment, and thus the conventional method is not suitable for the mass production of the reinforced fabrics in the future that people pay attention to the environmental protection increasingly.

Film lamination is also useful to reinforce the strength of the textile. The surface of the textile is dot-coated with a hot melt adhesive solution, and then covered with a reinforcing film to form a laminated structure. Finally, the laminated structure is hot-pressed under 200° C. to 300° C. to form the reinforced textile.

However, the hot melt adhesive layer is aged over time and would peel from the textile, and thus lose the property of high strength. Besides, the solvent contained in the hot melt adhesive solution might remain in the reinforced textile made by the film lamination, thereby limiting the applicability of the reinforced textile.

SUMMARY OF THE INVENTION

The objective of the present invention is to provide a reinforced composite fabric and a method for preparing a reinforced composite fabric which overcomes the problem of peeling of the reinforcing film and simplifies the fabrication process.

In order to achieve the aforementioned objective, the present invention provides a method for preparing a reinforced composite fabric including:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature (less than 200° C.) and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn.

In accordance with the present invention, two thermoplastic elastomeric yarns with different hardness or different melting points are hot-pressed at a suitable temperature to allow the low-hardness thermoplastic elastomeric yarn to be partially melted and attached on the surface of the high-hardness thermoplastic elastomeric yarn, so as to obtain the reinforced composite fabric. By means of the method described, the tensile strength and the impact strength are enhanced without using the hot melt adhesive solution. The drawbacks of aging of the hot melt adhesive layer, peeling of the reinforcing film, and residuals of the solvent are overcome. Further, the fabrication process of the reinforced fabric is simpler than the prior art.

Preferably, the hot-pressing pressure is from 0.1 $kgf/cm^2$ to 10 $kgf/cm^2$.

As for the method for preparing the reinforced composite fabric, the hot-pressing temperature is higher than the melting point of the low-hardness thermoplastic elastomeric yarn by 10° C. to 50° C. Preferably, the hot-pressing temperature is higher than the melting point of the low-hardness thermoplastic elastomeric yarn by 10° C. to 20° C. Therefore, the present invention can hot-press the fabric under a hot-pressing temperature lower than 200° C. and make the low-hardness thermoplastic elastomeric yarn partially melted.

According to the present invention, the hot-pressing temperature can be adjusted according to the melting point of the high-hardness thermoplastic elastomeric yarn and the melting point of the low-hardness thermoplastic elastomeric yarn. Preferably, the melting point of the low-hardness thermoplastic elastomeric yarn is from 50° C. to 150° C. More preferably, the melting point of the low-hardness thermoplastic elastomeric yarn is from 70° C. to 150° C. Therefore, the reinforced composite fabric is made under the lower hot-pressing temperature. Besides, the melting point of the high-hardness thermoplastic elastomeric yarn is from 150° C. to 300° C. More preferably, the melting point of the high-hardness thermoplastic elastomeric yarn is from 160° C. to 300° C. Much more preferably, the melting point of the high-hardness thermoplastic elastomeric yarn is from 180° C. to 250° C.

Preferably, a shore hardness of the low-hardness thermoplastic elastomeric yarn is from 10A to 90A and a shore hardness of the high-hardness thermoplastic elastomeric yarn is from 95A to 90D.

In addition, the method further comprises the step of twisting a high-hardness thermoplastic elastomeric fiber and a reinforcing fiber into the high-hardness thermoplastic elastomeric yarn.

The step of twisting a high-hardness thermoplastic elastomeric fiber and a reinforcing fiber makes the high-hardness thermoplastic elastomeric yarn have the characteristic of the reinforcing fiber. The addition of the reinforcing fiber widens the applicability of the reinforced composite fabric and may enhance the tensile strength and the impact strength of the reinforced composite fabric.

Preferably, the reinforcing fiber is a synthetic fiber. Further, the applicable synthetic fiber of the present invention includes a carbon fiber, a glass fiber, a Kevlar fiber, or a Dyneema fiber. A percentage of the reinforcing fiber ranges from 10 wt % to 90 wt % based on the overall weight of the high-hardness thermoplastic elastomeric yarn.

Preferably, the method further comprises the steps of melt spinning a high-hardness thermoplastic elastomeric polymer into the high-hardness thermoplastic elastomeric yarn and of melt spinning a low-hardness thermoplastic elastomeric polymer into the low-hardness thermoplastic elastomeric yarn. Besides, the high-hardness thermoplastic elastomeric polymer and the low-hardness thermoplastic elastomeric polymer independently are, but not limited to, thermoplastic rubber elastomer (TPR), thermoplastic polyurethane elastomer (TPU), styrene-based thermoplastic elastomer (TPS), thermoplastic olefinic elastomer (TPO), thermoplastic vulcanizate elastomer (TPV), thermoplastic ester elastomer (TPEE), or thermoplastic polyamide elastomer (TPAE).

Preferably, the high-hardness thermoplastic elastomeric polymer and the low-hardness thermoplastic elastomeric polymer are classified as the identical thermoplastic elastomeric polymer. Therefore, the reinforced composite fabric may have higher tensile strength and higher impact strength due to the same or better affinity between the high-hardness thermoplastic elastomeric yarn and the low-hardness thermoplastic elastomeric yarn.

The high-hardness thermoplastic elastomeric polymer and the low-hardness thermoplastic elastomeric polymer each respectfully have a soft segment and a hard segment. The hardness and the melting point of the thermoplastic elastomeric polymer may be adjusted according to a ratio of the soft segment to the hard segment.

The soft segment can be constructed by, but not limited to, butadiene rubber (BR), isoprene rubber (IR), natural rubber (NR), ethylene propylene diene monomer (EPDM), isobutylene isoprene rubber (IIR), polyisobutylene (PIB), polyethylene/polybutylene, amorphous polyethylene, polyether polyol, polyester polyol, or polyester.

The hard segment can be constructed by, but not limited to, polystyrene (PS), polyethylene (PE), polypropylene (PP), syndiotactic 1,2-polybutadiene, trans-1,4-polyisoprene, polyurethanes (PU), diisocyanate, or polyamide (PA).

Moreover, in the polyester-polyether type of TPEE system, the soft segment can be constructed by polyether and the hard segment can be constructed by aromatic crystal polyester. In the polyester-polyester type of TPEE system, the soft segment can be constructed by aliphatic polyester and the hard segment can be constructed by aromatic crystal polyester.

Preferably, the ratio of the soft segment to the hard segment of the high-hardness thermoplastic elastomeric polymer is from 25:75 to 50:50. The ratio of the soft segment to the hard segment of the low-hardness thermoplastic elastomeric polymer is from 51:49 to 80:20.

Preferably, the high-hardness thermoplastic elastomeric polymer and the low-hardness thermoplastic elastomeric polymer are both TPU. The ratio of the soft segment to the hard segment of the high-hardness thermoplastic elastomeric polymer is from 30:70 to 50:50. The ratio of the soft segment to the hard segment of the low-hardness thermoplastic elastomeric polymer is from 56:44 to 70:30.

Preferably, the high-hardness thermoplastic elastomeric polymer and the low-hardness thermoplastic elastomeric polymer are both TPEE. The ratio of the soft segment to the hard segment of the high-hardness thermoplastic elastomeric polymer is from 30:70 to 40:60. The ratio of the soft segment to the hard segment of the low-hardness thermoplastic elastomeric polymer is from 52:48 to 75:25.

Preferably, the high-hardness thermoplastic elastomeric polymer and the low-hardness thermoplastic elastomeric polymer are both TPO. The ratio of the soft segment to the hard segment of the high-hardness thermoplastic elastomeric polymer is from 30:70 to 40:60. The ratio of the soft segment to the hard segment of the low-hardness thermoplastic elastomeric polymer is from 55:45 to 75:25.

Preferably, the step of forming a high-hardness thermoplastic elastomeric yarn and a low-hardness thermoplastic elastomeric yarn into a fabric by weaving further comprises twisting the high-hardness thermoplastic elastomeric yarn and the low-hardness thermoplastic elastomeric yarn into multiple complex yarns and forming the complex yarns into the fabric. Each of the complex yarns comprises foresaid high-hardness thermoplastic elastomeric yarn and low-hardness thermoplastic elastomeric yarn twisted together.

The high-hardness thermoplastic elastomeric yarn and the low-hardness thermoplastic elastomeric yarn can form the fabric by a weaving method. The fabrics can be, but not limited to, circular knitted fabric, knitted fabric, jersey fabric, woven fabric, plain fabric, ribbing fabric, or corrugated fabric. Besides, the fabrics can be formed by different weaving methods in the same process, for example, the fabric can be formed by knitted weaving in combination with woven weaving and plain weaving.

Furthermore, the present invention provides a reinforced composite fabric comprising a high-hardness thermoplastic elastomeric yarn and a low-hardness thermoplastic elastomeric yarn. A part of a surface of the low-hardness thermoplastic elastomeric yarn is melted and attached on a surface of the high-hardness thermoplastic elastomeric yarn. The reinforced composite fabric can be made by the method mentioned above.

In conclusion, the reinforced composite fabric and the method for preparing the reinforced composite fabric have advantages as follows.

(1) High Mechanical Strength Property

Hot-pressing the fabric woven by the high-hardness thermoplastic elastomeric yarn and the low-hardness thermoplastic elastomeric yarn allows the reinforced composite fabric to have a higher tensile strength and a higher impact strength.

(2) Simple and Eco-Friendly Process

The method for preparing the reinforced composite fabric overcomes the problems to fabricate the reinforced textiles by the intensifiers impregnation and the film lamination.

(3) Low Hot-Pressing Temperature

By adjusting the melting point of the low-hardness thermoplastic elastomeric yarn, the reinforced composite fabric can be hot-pressed under a lower hot-pressing temperature.

DETAILED DESCRIPTION OF INVENTION

To prove that the reinforced composite fabric has a higher tensile strength and a higher impact strength, the reinforced composite fabric and the method for preparing the same is provided as follows. Hereinafter, one skilled in the arts can easily realize the advantages and effects of the present invention from the following examples. Various modifications and variations can be made in order to practice or apply the present invention without departing from the spirit and scope of the invention.

Example 1

A high-hardness thermoplastic elastomeric (abbreviated as HH-TPE) polymer used in the instant example was thermoplastic polyurethane elastomer (TPU), which had a soft segment and a hard segment at a ratio of 44:56. The soft segment was constructed by polyol and the hard segment was constructed by diisocyanate. The HH-TPE polymer having a shore hardness of 95A and a melting point of 190° C. was melt spun to prepare a HH-TPE yarn (150D/72F).

A low-hardness thermoplastic elastomeric (abbreviated as LH-TPE) polymer used in the instant example was TPU and had a soft segment and a hard segment at a ratio of 65:35. The soft segment was constructed by polyol and the hard segment was constructed by diisocyanate. The LH-TPE polymer having a shore hardness of 80A and a melting point of 100° C. was melt spun to prepare a LH-TPE yarn (150D/72F).

The HH-TPE yarn and the LH-TPE yarn were crossed upon each other at a ratio of 1:1 to form a woven fabric. The size of the woven fabric was 21 cm×30 cm. The structure of the woven fabric was shown in FIG. 1.

Figure 1:
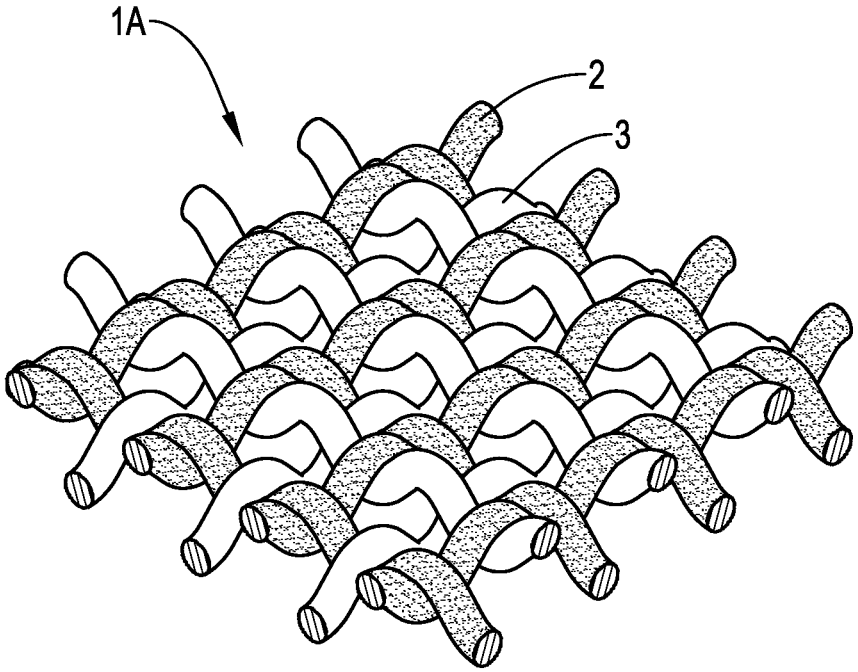
FIG. 1 is a perspective view of a reinforced woven fabric made from high-hardness thermoplastic elastomeric yarns and low-hardness thermoplastic elastomeric yarns at a ratio of 1:1.

With reference to FIG. 1, the woven fabric 1A was composed of the HH-TPE yarn 2 and the LH-TPE yarn 3. The warp was composed of the HH-TPE yarn 2 and the LH-TPE yarn 3 at a ratio of 1:1, and the weft was composed of the HH-TPE yarn 2 and the LH-TPE yarn 3 at a ratio of 1:1. That is, the HH-TPE yarn 2 and the LH-TPE yarn 3 were staggered together in both lateral direction and vertical direction. Subsequently, the woven fabric 1A was preheated under 100° C. for half an hour and hot-pressed under 110° C. and a pressure of 1 kgf/cm$^2$ for 3 minutes. After cooling the hot-pressed woven fabric, a reinforced composite fabric was finally obtained.

Example 2

A HH-TPE yarn (150D/72F) and a LH-TPE yarn (150D/72F) used in the instant example were similar with those in Example 1.

Differently, the HH-TPE yarn and the LH-TPE yarn were crossed upon each other at a ratio of 2:1 to form a woven fabric. The structure of the woven fabric was shown in FIG. 2.

Figure 2:
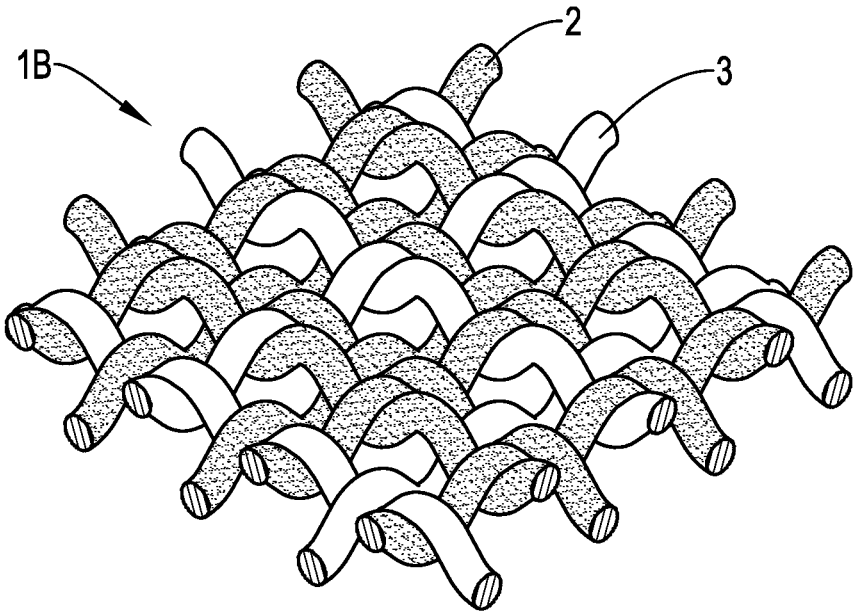
FIG. 2 is a perspective view of the reinforced woven fabric made from the high-hardness thermoplastic elastomeric yarns and low-hardness thermoplastic elastomeric yarns at a ratio of 2:1.

With reference to FIG. 2, the woven fabric 1B was composed of the HH-TPE yarn 2 and the LH-TPE yarn 3. The warp was composed of the HH-TPE yarn 2 and the LH-TPE yarn 3 at a ratio of 2:1, and the weft was composed of the HH-TPE yarn 2 and the LH-TPE yarn 3 at a ratio of 2:1. That is, two HH-TPE yarns 2 and one LH-TPE yarn 3 were arranged repeatedly in both lateral direction and vertical direction.

Subsequently, the woven fabric 1B was preheated and hot-pressed as described in Example 1 to form a reinforced composite fabric of Example 2.

Example 3

A HH-TPE polymer used in the instant example was thermoplastic polyether ester elastomer (TPEE), which had a soft segment and a hard segment at a ratio of 37:63. The soft segment was constructed by aliphatic polyester and the hard segment was constructed by aromatic crystal polyester. The HH-TPE polymer having a shore hardness of 72D and a melting point of 220° C. was melt spun to prepare a HH-TPE yarn (150D/72F).

A LH-TPE polymer used in the instant example was TPEE, which had a soft segment and a hard segment at a ratio of 62:38. The soft segment was constructed by aliphatic polyester and the hard segment was constructed by aromatic crystal polyester. The LH-TPE polymer having a shore hardness of 30D and a melting point of 150° C. was melt spun to prepare a LH-TPE yarn (150D/72F).

The HH-TPE yarn and the LH-TPE yarn were crossed upon each other at a ratio of 1:1 to form a woven fabric similarly as Example 1. Subsequently, the woven fabric was preheated and hot-pressed as described in Example 1 to form a reinforced composite fabric of Example 3. Differently, the preheating temperature to the woven fabric was 150° C. and the hot-pressing temperature to the woven fabric was 170° C.

Example 4

A HH-TPE polymer used in the instant example was thermoplastic olefinic elastomer (TPO), which had a soft segment and a hard segment at a ratio of 35:65. The soft segment was constructed by ethylene propylene diene monomer (EPDM) and the hard segment was constructed by polypropylene (PP). The HH-TPE polymer having a shore hardness of 75D and a melting point of 160° C. was melt spun to prepare a HH-TPE yarn (150D/72F).

A LH-TPE polymer used in the instant example was TPO, which had a soft segment and a hard segment at a ratio of 68:32. The soft segment was constructed by EPDM and the hard segment was constructed by PP. The LH-TPE polymer having a shore hardness of 56A and a melting point of 70° C. was melt spun to prepare a LH-TPE yarn (150D/72F).

The HH-TPE yarn and the LH-TPE yarn were crossed upon each other at a ratio of 1:1 to form a woven fabric similarly as in Example 1. The woven fabric was preheated and hot-pressed as described in Example 1 to form a reinforced composite fabric of Example 4. Differently, the preheating temperature to the woven fabric was 70° C. and the hot-pressing temperature to the woven fabric was 100° C.

Example 5

A HH-TPE polymer used in the instant example similarly as in Example 1 was melt spun to prepare a HH-TPE fiber (75D/36F). The HH-TPE fiber and a polyethylene terephthalate (PET) fiber (75D/36F) were twisted to form a HH-TPE yarn (150D/72F).

A LH-TPE polymer similarly as in Example 1 was melt spun to prepare a LH-TPE yarn (150D/72F).

The HH-TPE yarn and the LH-TPE yarn were crossed upon each other at a ratio of 1:1 to form a woven fabric similarly as in Example 1. Subsequently, the woven fabric was preheated and hot-pressed as described in Example 1 to form a reinforced composite fabric of Example 5.

Example 6

A HH-TPE yarn (150D/72F) and a LH-TPE yarn (150D/72F) used in the instant example were similar to those in Example 1. Differently, the HH-TPE yarn and the LH-TPE yarn were knitted at a ratio of 1:1 to form a knitted fabric. Subsequently, the knitted fabric was preheated and hot-pressed as described in Example 1 to form a reinforced composite fabric of Example 6.

Example 7

A HH-TPE yarn (150D/72F) and a LH-TPE yarn (150D/72F) used in the instant example were similar to those in Example 5. Differently, the HH-TPE yarn and the LH-TPE yarn were knitted at a ratio of 1:1 to form a knitted fabric. Subsequently, the knitted fabric was preheated and hot-pressed as described in Example 5 to form a reinforced composite fabric of Example 7.

Example 8

A HH-TPE yarn (150D/72F) used in the instant example was similar to that in Example 1. A LH-TPE yarn (150D/72F) used in the instant example was similar to that in Example 4. Besides, the HH-TPE yarn and the LH-TPE yarn were crossed upon each other at a ratio of 1:1 to form a woven fabric.

Subsequently, the woven fabric was preheated and hot-pressed as described in Example 4 to form a reinforced composite fabric of Example 8.

Comparative Example 1

A HH-TPE polymer used in the instant comparative example similarly as in Example 1 was melt spun to prepare two identical HH-TPE yarns (150D/72F). The two HH-TPE yarns were crossed upon each other to form a woven fabric similarly as in Example 1.

Subsequently, the woven fabric was preheated and hot-pressed as described in Example 1.

After hot-pressing the woven fabric, an appearance of the hot-pressed woven fabric was unchanged.

Comparative Example 2

A woven fabric used in the instant comparative example was similar to that in Comparative Example 1.

Subsequently, the woven fabric was preheated and hot-pressed as described in Example 1. Differently, the preheating temperature to the woven fabric was 190° C. and the hot-pressing temperature to the woven fabric was 230° C.

After hot-pressing the woven fabric, the two HH-TPE yarns were melted and formed into a piece of TPU polymer film. The piece of TPU polymer no longer had a texture of the woven fabric.

Test Example

In order to clarify the differences among Examples 1 to 8, the properties of the HH-TPE polymers and the properties of the LH-TPE polymers were listed in Table 1.

To measure the mechanical properties of the reinforced composite fabric, the tensile strength of the fabric and the tensile strength of the reinforced composite fabric were measured according to ASTM-D142 specified by American Society for Testing and Materials (ASTM). Also, the impact strength of the fabric and the impact strength of the reinforced composite fabric were measured according to ASTM-D256 specified by ASTM.

To clarify the differences among Examples and Comparative Examples, the operating conditions and the properties of the reinforced composite fabrics in Examples 1 to 8 and in Comparative Example 1 were listed in Table 2.

TABLE 1 the type of the HH-TPE polymers, the ratios of the soft segment to the hard segment (abbreviated as SS:HS) of the HH-TPE polymers, the shore hardness of the HH-TPE polymers, and the melting points of the HH-TPE polymers in Examples 1 to 8 (abbreviated as E1 to E8) and the type of the LH-TPE polymers, the SS:HS ratios of the LH-TPE polymers, the shore hardness of the LH-TPE polymers, and the melting points (° C.) of the LH-TPE polymers in Examples 1 to 8 (abbreviated as E1 to E8).

| | HH-TPE polymer | | | | LH-TPE polymer | | | |
|---|---|---|---|---|---|---|---|---|
| | Type | SS:HS | Hardness | Melting point | Type | SS:HS | Hardness | Melting point |
| E1 | TPU | 44:56 | 95A | 190 | TPU | 65:35 | 80A | 100 |
| E2 | TPU | 44:56 | 95A | 190 | TPU | 65:35 | 80A | 100 |
| E3 | TPEE | 37:63 | 72D | 220 | TPEE | 62:38 | 30D | 150 |
| E4 | TPO | 35:65 | 75D | 160 | TPO | 68:32 | 56A | 70 |
| E5 | TPU | 44:56 | 95A | 190 | TPU | 65:35 | 80A | 100 |
| E6 | TPU | 44:56 | 95A | 190 | TPU | 65:35 | 80A | 100 |
| E7 | TPU | 44:56 | 95A | 190 | TPU | 65:35 | 80A | 100 |
| E8 | TPU | 44:56 | 95A | 190 | TPO | 68:32 | 56A | 70 |

TABLE 2 the ratios of the HH-TPE yarn to the LH-TPE yarn (abbreviated as HH-yarn:LH-yarn) of the fabrics, the preheating temperatures (° C.) to the fabrics, the hot-pressing temperatures (° C.) to the fabrics, tensile strengths (kgf/cm$^2$) of the fabrics, tensile strengths (kgf/cm$^2$) of the reinforced composite fabrics, impact strengths (J/m) of the fabrics, and impact strengths (J/m) of the reinforced composite fabrics in Examples 1 to 8 and Comparative Example 1 (abbreviated as E1 to E8 and C1).

| | | | | Tensile strength | | Impact strength | |
|---|---|---|---|---|---|---|---|
| | HH-yarn: LH-yarn | Pre-heating temperature | Hot-pressing temperature | Fabric | Reinforced composite fabric | Fabric | Reinforced composite fabric |
| E1 | 1:1 | 100 | 110 | 253 | 651 | 43 | 871 |
| E2 | 2:1 | 100 | 110 | 350 | 453 | 69 | 556 |
| E3 | 1:1 | 150 | 170 | 169 | 436 | 32 | 583 |
| E4 | 1:1 | 70 | 100 | 106 | 243 | 83 | 638 |
| E5 | 1:1 | 100 | 110 | 384 | 531 | 33 | 287 |
| E6 | 1:1 | 100 | 110 | 131 | 374 | 24 | 418 |
| E7 | 1:1 | 100 | 110 | 198 | 261 | 30 | 148 |
| E8 | 1:1 | 70 | 100 | 183 | 347 | 63 | 323 |
| C1 | 1:1 | 100 | 110 | 286 | 281 | 62 | 61 |

With reference to Table 1, the HH-/LH-TPE yarns can be prepared by the HH-/LH-TPE polymers with different hardness or different melting points by controlling the SS:HS ratios of the HH-/LH-TPE polymers.

With reference to Table 2, the tensile strengths and the impact strengths of the reinforced composite fabrics in Examples 1 to 8 were higher than those of the fabrics in Examples 1 to 8. Therefore, the present invention could prepare the reinforced composite fabrics with higher tensile strength and higher impact strength.

In order to enhance the affinities between the HH-TPE yarn and the LH-TPE yarn, the HH-TPE polymer and the LH-TPE polymer were classified as identical thermoplastic elastomeric polymer in Examples 1 to 7.

With reference to Table 1, the LH-TPE polymer and the HH-TPE polymer in Examples 1, 2, 5, and 8 were TPU. When the SS:HS ratios of the LH-TPE polymer ranged from 56:44 to 70:30, the shore hardness of the LH-TPE yarn ranged from 10A to 90A and the melting points of the LH-TPE yarn ranged from 50° C. to 150° C. When the SS:HS ratios of the HH-TPE polymer ranged from 30:70 to 50:50, the shore hardness of the HH-TPE yarn ranged from 95A to 90D and the melting points of the HH-TPE yarn ranged from 170° C. to 300° C.

With reference to Table 1, the LH-TPE polymer and the HH-TPE polymer in Example 3 were TPEE. When the SS:HS ratio of the LH-TPE polymer ranged from 52:48 to 75:25, the shore hardness of the LH-TPE yarn ranged from 30D to 60D and the melting point of the LH-TPE yarn ranged from 100° C. to 180° C. When the SS:HS ratio of the HH-TPE polymer ranged from 30:70 to 40:60, the shore hardness of the HH-TPE yarn ranged from 65D to 80D and the melting points of the HH-TPE yarn ranged from 185° C. to 280° C.

With reference to Table 1, the LH-TPE polymer and the HH-TPE polymer in Examples 4 and 8 were TPO. When the SS:HS ratios of the LH-TPE polymer ranged from 55:45 to 75:25, the shore hardness of the LH-TPE yarn ranged from 30A to 60A and the melting point of the LH-TPE yarn ranged from 50° C. to 80° C. When the SS:HS ratios of the HH-TPE polymer ranged from 30:70 to 40:60, the shore hardness of the HH-TPE yarn ranged from 65A to 90A and the melting point of the HH-TPE yarn ranged from 100° C. to 180° C.

With reference to Table 2, by using identical type of the LH-TPE polymer and the HH-TPE polymer, the tensile strengths and the impact strengths of the reinforced composite fabrics in Examples 1 to 7 were enhanced after hot-pressing.

Comparing Examples 1 with 8, the HH-TPE polymers in Examples 1 and 8 were both TPU. Differently, the LH-TPE polymer in Example 1 was TPU but the LH-TPE polymer in Example 8 was TPO. With reference to Table 2, the tensile strength and the impact strength of the reinforced composite fabric in Example 1 were higher than those in Example 8 due to the higher affinity between the HH-TPE yarn and the LH-TPE yarn.

Comparing Examples 4 with 8, the LH-TPE polymers in Examples 4 and 8 were both TPO. Differently, the HH-TPE polymer in Example 4 was TPO but the HH-TPE polymer in Example 8 was TPU. With reference to Table 2, due to the tensile reinforcement of the TPU, the tensile strength of the reinforced composite fabric in Example 8 was higher than that in Example 4. In addition, due to the higher affinity between the HH-TPE yarn and the LH-TPE yarn, the impact strength of the reinforced composite fabric in Example 4 was higher than that in Example 8. Therefore, the reinforced composite fabric prepared by various types of HH-TPE polymers or by various types of LH-TPE polymers would have different characteristics of mechanical strengths.

Further, other kinds of fiber could be included in the HH-TPE yarn or the LH-TPE yarn hence to form the reinforced composite fabric with different characteristics. With reference to Table 2, the PET fiber and the TPU fiber were twisted to form the HH-TPE yarn in Examples 5 and 7. The tensile strengths and the impact strengths of the reinforced composite fabrics in Examples 5 and 7 were increased. The tensile strength of the reinforced composite fabric in Example 5 was 531 kgf/cm$^2$; the impact strength of the reinforced composite fabric in Example 5 was 287 J/m. The tensile strength of the reinforced composite fabric in Example 7 was 267 kgf/cm$^2$; the impact strength of the reinforced composite fabric in Example 7 was 148 J/m.

Comparing Examples 1 to 5 with Examples 6 and 7, the fabrics in Examples 1 to 5 were woven fabrics and the fabrics in Examples 6 and 7 were knitted fabrics. With reference to Table 2, no matter what fabrics were made, the tensile strengths and the impact strengths of the reinforced composite fabrics were increased after hot-pressing. Therefore, various types of fabrics were suitable for use in the method for preparing the reinforced composite fabric.

To compare the woven fabrics with knitted fabrics, a first group (Examples 1 and 6) and a second group (Examples 5 and 7) were respectively prepared similarly. That is, the difference between the first group and the second group was only the types of the fabrics. With reference to Table 2, the tensile strength and the impact strength of the reinforced composite fabric made by woven fabrics (Examples 1 and 5) were higher than those of the reinforced composite fabric made by knitted fabrics (Examples 6 and 7).

Comparing Example 1 with Comparative Example 1, the woven fabric in Comparative Example 1 was woven by two identical HH-TPE yarns. After preheating and hot-pressing the woven fabric, the woven fabric did not form the reinforced composite fabric. With reference to Table 2, the tensile strength and the impact strength of the reinforced composite fabric in Comparative Example 1 did not increase obviously.

Comparing Example 1 with Comparative Example 2, the woven fabric in Comparative Example 2 was woven by two identical HH-TPE yarns and the hot-pressing temperature was not higher than or equal to the melting point of the HH-TPE yarn. From the result, the woven fabric in the Comparative Example 2 not only could not form the reinforced composite fabric but also would lose the texture of the fabric. Therefore, using the HH-TPE yarn and the LH-TPE yarn and controlling the hot-pressing temperature to the fabrics in a specific range are important features to prepare the reinforced composite fabrics.

What is claimed is:

1. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein a shore hardness of the low-hardness thermoplastic elastomeric yarn is from 10A to 90A and a shore hardness of the high-hardness thermoplastic elastomeric yarn is from 95A to 90D.

2. The method for preparing the reinforced composite fabric as claimed in claim 1, wherein the hot-pressing temperature is higher than the melting point of the low-hardness thermoplastic elastomeric yarn by 10° C. to 50° C.

3. The method for preparing the reinforced composite fabric as claimed in claim 1, wherein the melting point of the high-hardness thermoplastic elastomeric yarn is from 150° C. to 300° C.

4. The method for preparing the reinforced composite fabric as claimed in claim 1, wherein the method comprises twisting a high-hardness thermoplastic elastomeric fiber and a reinforcing fiber into the high-hardness thermoplastic elastomeric yarn.

5. The method for preparing the reinforced composite fabric as claimed in claim 4, wherein the reinforcing fiber includes a carbon fiber, a glass fiber, a Kevlar fiber, or a Dyneema fiber; a percentage of the reinforcing fiber ranges from 10 wt % to 90 wt % based on the overall weight of the high-hardness thermoplastic elastomeric yarn.

6. The method for preparing the reinforced composite fabric as claimed in claim 1, wherein the method comprises:

melt spinning a high-hardness thermoplastic elastomeric polymer into the high-hardness thermoplastic elastomeric yarn; and melt spinning a low-hardness thermoplastic elastomeric polymer into the low-hardness thermoplastic elastomeric yarn; wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer.

7. The method for preparing the reinforced composite fabric as claimed in claim 2, wherein the method comprises:

melt-spinning a high-hardness thermoplastic elastomeric polymer into the high-hardness thermoplastic elastomeric yarn; and melt-spinning a low-hardness thermoplastic elastomeric polymer into the low-hardness thermoplastic elastomeric yarn; wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer.

8. The method for preparing the reinforced composite fabric as claimed in claim 3, wherein the method comprises:

melt-spinning a high-hardness thermoplastic elastomeric polymer into the high-hardness thermoplastic elastomeric yarn; and melt-spinning a low-hardness thermoplastic elastomeric polymer into the low-hardness thermoplastic elastomeric yarn; wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer.

9. The method for preparing the reinforced composite fabric as claimed in claim 6, wherein the high-hardness thermoplastic elastomeric polymer and the low-hardness thermoplastic elastomeric polymer are classified as identical thermoplastic elastomeric polymer.

10. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein the method comprises:

melt spinning a high-hardness thermoplastic elastomeric polymer into the high-hardness thermoplastic elastomeric yarn; and melt spinning a low-hardness thermoplastic elastomeric polymer into the low-hardness thermoplastic elastomeric yarn;

wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer; and wherein the high-hardness thermoplastic elastomeric polymer and the low-hardness thermoplastic elastomeric polymer each respectively have a soft segment and a hard segment; a ratio of the soft segment to the hard segment of the high-hardness thermoplastic elastomeric polymer ranges from 25:75 to 50:50; a ratio of the soft segment to the hard segment of the low hardness thermoplastic elastomeric polymer ranges from 51:49 to 80:20.

11. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein the method comprises:

melt spinning a high-hardness thermoplastic elastomeric polymer into the high-hardness thermoplastic elastomeric yarn; and melt spinning a low-hardness thermoplastic elastomeric polymer into the low-hardness thermoplastic elastomeric yarn;

wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer; and wherein the high-hardness thermoplastic elastomeric polymer and the low-hardness thermoplastic elastomeric polymer are both classified as thermoplastic polyurethane elastomer;

the high-hardness thermoplastic elastomeric polymer and the low-hardness thermoplastic elastomeric polymer each respectfully have a soft segment and a hard segment; a ratio of the soft segment to the hard segment of the high-hardness thermoplastic elastomeric polymer ranges from 30:70 to 50:50; a ratio of the soft segment to the hard segment of the low-hardness thermoplastic elastomeric polymer ranges from 56:44 to 70:30.

12. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein the method comprises:

melt spinning a high-hardness thermoplastic elastomeric polymer into the high-hardness thermoplastic elastomeric yarn; and melt spinning a low-hardness thermoplastic elastomeric polymer into the low-hardness thermoplastic elastomeric yarn;

wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer; and wherein the high-hardness thermoplastic elastomeric polymer and the low-hardness thermoplastic elastomeric polymer are both classified as thermoplastic polyether ester elastomer; the high-hardness thermoplastic elastomeric polymer and the low-hardness thermoplastic elastomeric polymer each respectively have a soft segment and a hard segment; a ratio of the soft segment to the hard segment of the high-hardness thermoplastic elastomeric polymer ranges from 30:70 to 40:60; a ratio of the soft segment to the hard segment of the low-hardness thermoplastic elastomeric polymer ranges from 52:48 to 75:25.

13. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein the method comprises:

melt spinning a high-hardness thermoplastic elastomeric polymer into the high-hardness thermoplastic elastomeric yarn; and melt spinning a low-hardness thermoplastic elastomeric polymer into the low-hardness thermoplastic elastomeric yarn;

wherein the high-hardness thermoplastic elastomeric polymer and the low-hardness thermoplastic elastomeric polymer independently are thermoplastic rubber elastomer, thermoplastic polyurethane elastomer, styrene-based thermoplastic elastomer, thermoplastic olefinic elastomer, thermoplastic vulcanizate elastomer, thermoplastic ester elastomer, or thermoplastic polyamide elastomer; and wherein the high-hardness thermoplastic elastomeric polymer and the low-hardness thermoplastic elastomeric polymer are both classified as thermoplastic olefinic elastomer; the high-hardness thermoplastic elastomeric polymer and the low-hardness thermoplastic elastomeric polymer each respectively have a soft segment and a hard segment; a ratio of the soft segment to the hard segment of the high-hardness thermoplastic elastomeric polymer ranges from 30:70 to 40:60; a ratio of the soft segment to the hard segment of the low-hardness thermoplastic elastomeric polymer ranges from 55:45 to 75:25.

14. A method for preparing a reinforced composite fabric, comprising steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn;

wherein the step of forming a high-hardness thermoplastic elastomeric yarn and a low-hardness thermoplastic elastomeric yarn into a fabric by weaving further comprises twisting the high hardness thermoplastic elastomeric yarn and the low-hardness thermoplastic elastomeric yarn into multiple complex yarns and weaving the multiple complex yarns into the fabric; each of the complex yarns comprises foresaid high-hardness thermoplastic elastomeric yarn and low hardness thermoplastic elastomeric yarn twisted together.

15. A reinforced composite fabric, comprising:

a high-hardness thermoplastic elastomeric yarn and a low-hardness thermoplastic elastomeric yarn; a part of a surface of the low-hardness thermoplastic elastomeric yarn being melted and attached on a surface of the high-hardness thermoplastic elastomeric yarn, wherein a shore hardness of the low-hardness thermoplastic elastomeric yarn is from 10A to 90A and a shore hardness of the high-hardness thermoplastic elastomeric yarn is from 95A to 90D.

16. The reinforced composite fabric as claimed in claim 15, wherein the reinforced composite fabric is made by the method for preparing a reinforced composite fabric, the method comprises steps of:

forming a high-hardness thermoplastic elastomeric yarn and a low-hardness thermoplastic elastomeric yarn into a fabric by weaving; a melting point of the low-hardness thermoplastic elastomeric yarn ranging from 50° C. to 150° C.;

hot-pressing the fabric under a hot-pressing temperature and a hot-pressing pressure to form the reinforced composite fabric; the hot-pressing temperature being higher than or equal to the melting point of the low-hardness thermoplastic elastomeric yarn, and lower than a melting point of the high-hardness thermoplastic elastomeric yarn.

17. The reinforced composite fabric as claimed in claim 16, wherein the method comprises twisting a high-hardness thermoplastic elastomeric fiber and a reinforcing fiber into the high-hardness thermoplastic elastomeric yarn.

18. The reinforced composite fabric as claimed in claim 16, wherein the method comprises forming a high-hardness thermoplastic elastomeric yarn and a low-hardness thermoplastic elastomeric yarn into a fabric by weaving further comprises twisting the high hardness thermoplastic elastomeric yarn and the low-hardness thermoplastic elastomeric yarn into multiple complex yarns and weaving the multiple complex yarns into the fabric; each of the complex yarns comprises foresaid high-hardness thermoplastic elastomeric yarn and low hardness thermoplastic elastomeric yarn twisted together.

* * * * *